US008487781B2

(12) United States Patent
Fuller et al.

(10) Patent No.: US 8,487,781 B2
(45) Date of Patent: Jul. 16, 2013

(54) SENSOR NODES ACTING AS INDUCTIVE LOOPS FOR TRAFFIC SENSING

(75) Inventors: Brian Anthony Fuller, Fremont, CA (US); Michael T. Volling, Georgetown, TX (US); Kenneth Brian Cox, St. Louis, MO (US)

(73) Assignee: Sensys Networks, Inc., Berkeley, CA (US)

( * ) Notice: Subject to any disclaimer, the term of this patent is extended or adjusted under 35 U.S.C. 154(b) by 329 days.

(21) Appl. No.: 12/948,656

(22) Filed: Nov. 17, 2010

(65) Prior Publication Data

US 2012/0026013 A1 Feb. 2, 2012

Related U.S. Application Data

(60) Provisional application No. 61/369,033, filed on Jul. 29, 2010.

(51) Int. Cl.
*G08G 1/00* (2006.01)

(52) U.S. Cl.
USPC ..... 340/928; 340/933; 340/934

(58) Field of Classification Search
USPC ..... 340/928, 941, 933, 919, 931, 935, 340/934; 404/9, 72; 701/117, 118
See application file for complete search history.

(56) References Cited

U.S. PATENT DOCUMENTS

| | | | | |
|---|---|---|---|---|
| 6,337,640 | B2 * | 1/2002 | Lees | 340/933 |
| 6,342,845 | B1 * | 1/2002 | Hilliard et al. | 340/941 |
| 6,345,228 | B1 * | 2/2002 | Lees | 701/117 |
| 6,483,443 | B1 * | 11/2002 | Lees et al. | 340/933 |
| 2007/0050240 | A1 | 3/2007 | Belani et al. | |
| 2008/0238720 | A1 | 10/2008 | Lee | |
| 2008/0287144 | A1 | 11/2008 | Sabata et al. | |
| 2010/0017103 | A1 * | 1/2010 | Kwong et al. | 701/117 |
| 2010/0073154 | A1 | 3/2010 | Kim et al. | |

* cited by examiner

*Primary Examiner* — Toan N Pham
(74) *Attorney, Agent, or Firm* — Earle Jennings

(57) ABSTRACT

Sensor nodes are disclosed that act like inductive loops to detect the presence and/or movement of vehicles on at least one roadway. Processors are disclosed using at least one sensor node to communicate vehicle detection that is statistically compatible with the inductive loop response to the vehicles. Installation may configure at least one of the sensor nodes to implement the inductive loop compatibility. Sensor clusters of sensor nodes installed in a roadway may act as inductive loops. Computer readable memories, installation devices and/or servers may deliver a program system and/or a Finite State Machine (FSM) configuration to implement the compatibility and/or an installation package to install the program system and/or the FSM configuration.

14 Claims, 8 Drawing Sheets

SENSOR NODES ACTING AS INDUCTIVE LOOPS FOR TRAFFIC SENSING

CROSS REFERENCE TO RELATED PATENT APPLICATIONS

This patent application claims priority to Provisional Patent Application No. 61/369,033, filed Jul. 29, 2010, entitled "Sensor Nodes Acting as Inductive Loops for Traffic Sensing" which is incorporated herein in its entirety.

TECHNICAL FIELD

This invention relates to sensor nodes acting as inductive loops to detect the presence and/or movement of vehicles on at least one roadway. The invention further relates to processors using at least one sensor node to communicate vehicle detection to a traffic management system. The vehicle detection is statistically compatible with the inductive loop response to the vehicles. The invention also relates to the sensor nodes, and/or their installation, configuring at least one of the sensor nodes to implement the inductive loop compatibility. The invention also relates to clusters of sensor nodes, referred to herein as sensor clusters, installed in a roadway to act as inductive loops.

BACKGROUND OF THE INVENTION

Inductive loops have been employed for years in traffic management systems to provide vehicle detection and are often used to monitor traffic flow. When properly installed and maintained, the inductive loops provide a high level of accuracy. However, they are prone to fail due to any of the following: cracks in the pavement, freeze and thaw cycles, roadway displacement, poor installation, construction on the roadside and/or the roadway. When any part of the inductive loop wiring is damaged or destroyed, detecting vehicles with the inductive loop becomes erratic or stops entirely.

Detection devices are needed to solve the reliability problems of inductive loops. These detection devices need to be reliable, long lasting and/or more immune to the problems of weather and aging of the roadways and the detection devices.

SUMMARY OF INVENTION

Before discussing the various embodiments of the invention, there is another problem to point out. Until recently, inductive loops were the only vehicle detection devices used in most, if not all, traffic management systems. As various adaptive control systems and programs evolved to handle traffic control, they exclusively relied on these inductive loops. In some situations more recent vehicle detection sensors have turned out to be more sensitive than the inductive loops. However, the owners and managers of pre-existing traffic management systems may require that the newer sensors be just as insensitive as the old inductive loops in order to minimize upgrade expenses and/or compatibility issues to the adaptive control software.

The apparatus embodiments of the invention may include a processor configured to use at least one sensor node positioned in a roadway to detect a vehicle passing near the sensor node. A vehicle detection is generated that is statistically compatible with the detection of the vehicle by an inductive loop. The vehicle detection may be used by a traffic management system to provide a traffic flow estimate of the roadway.

Other apparatus embodiments may include sensor clusters configured to act like an inductive loop in response to a vehicle passing near the apparatus. The sensor cluster may include a first and second sensor node, with the first sensor node configured to generate a start of the vehicle detection and the second sensor node configured to generate an end of the vehicle detection. Both sensor nodes may be installed so that the vehicle approaches the first sensor node before traveling away from the second sensor node.

The sensor node may include a wireless transceiver and/or a magnetic sensor. The wireless transceiver may be configured to deliver at least part of the vehicle detection. The magnetic sensor may be configured to respond to the presence of the vehicle to generate at least part of the vehicle detection. The magnetic sensor may employ the Hall effect and/or a magneto-resistive effect, to respond to the presence of the vehicle. The sensor node may also include a wireline transceiver, possibly compliant with a wireline communications protocol.

The processor may include at least one instance of a finite state machine and/or of a computer. The processor may further include a memory that may be configured for access by the finite state machine and/or by the computer. The memory may contain a program system and/or an installation package configured to instruct the computer to install the program system in the finite state machine and/or the computer.

Embodiments of the invention include a server, an installation device, and/or a computer readable memory, configured to deliver the program system and/or the installation package to the processor.

The program system may include at least one of the program steps of generating the vehicle detection by using the sensor node response to the presence of the vehicle and/or sending the vehicle detection to the traffic management system. Various embodiments may implement these program steps differently. For instance, generating the vehicle detection may include altering the vehicle detection to be compatible with the inductive loop for a specific traffic management system and/or the adaptive control system. The alteration may alter the ending time and/or the start time of the vehicle detection. The alteration may retard or extend one or both of these times. As used herein, retarding a time moves it earlier and extending a time moves it later.

The apparatus may include an access point and/or a router to communicate with the sensor node to support the processor using the sensor node. The access point and/or the router may include the processor.

In other embodiments, the processor may be included in a traffic controller, the traffic management system and/or the adaptive controller. Alternatively, the processor may be an independent component communicating with the traffic controller, the traffic management system and/or the adaptive controller.

DETAILED DESCRIPTION OF DRAWINGS

This invention relates to sensor nodes acting as inductive loops to detect the presence and/or movement of vehicles on at least one roadway. The invention further relates to processors using at least one sensor node to communicate vehicle detection to a traffic management system that is statistically compatible with the inductive loop response to the vehicles. The invention also relates to the sensor nodes and/or their installation configuring at least one of the sensor nodes to implement the inductive loop compatibility. The invention also relates to the sensor clusters of sensor nodes installed in a roadway to act as inductive loops.

Figure 1:
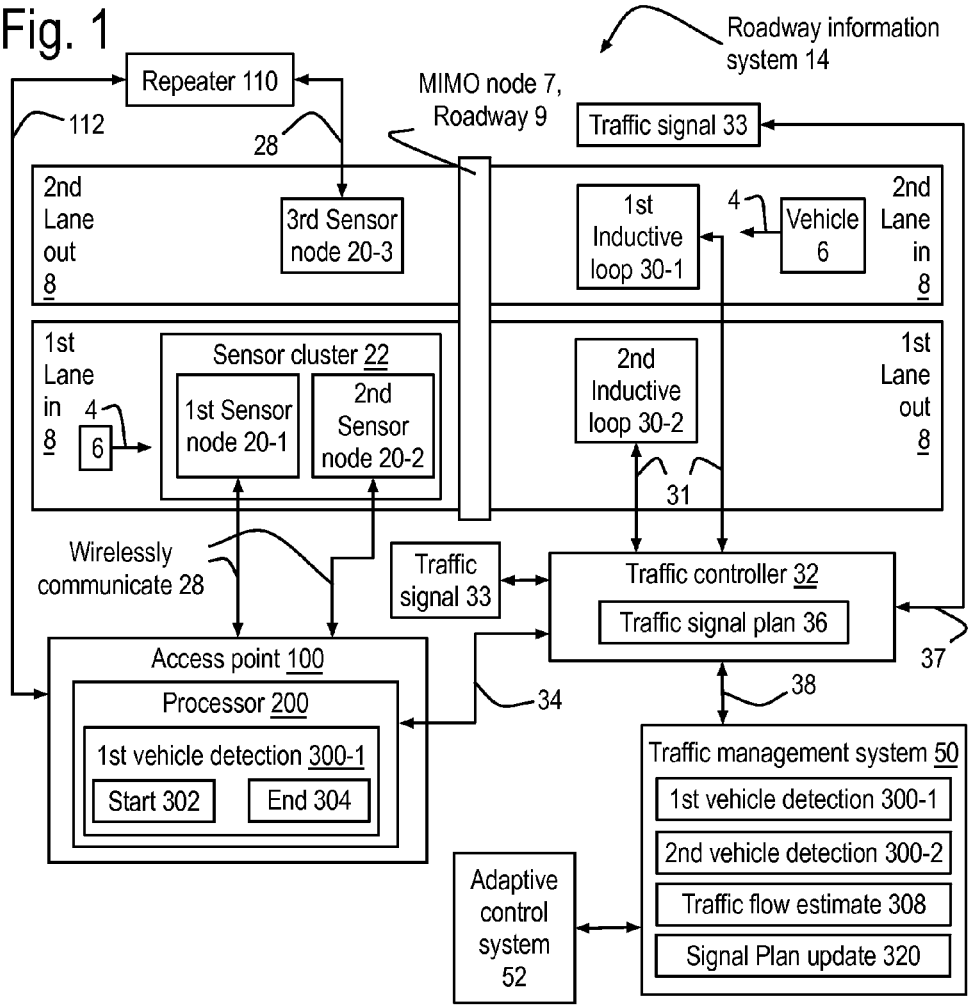
FIG. 1 shows a simplified block diagram of a roadway information system operating one or more sensor nodes wirelessly communicating with an access point with a processor to provide a vehicle detection statistically compatible with an inductive loop for a traffic management system to generate a traffic flow estimate.

FIG. 1 shows a simplified block diagram of a roadway information system 14 for a roadway 9 including multiple lanes 8 intersecting at a Multiple Input Multiple Output (MIMO) node 7. The roadway information system 14 may operate one or more sensor nodes 20 wirelessly communicating 26 with an access point 100 including a processor 200. The processor may communicate 34 through a traffic controller 32 to provide a vehicle detection 300 statistically compatible with an inductive loop 30 for a traffic management system 50 to generate a traffic flow estimate 308. The communicating 34 may include a wireline interface to the traffic controller 32 supporting a SDLC communications protocol and/or a line card to install in a rack slot of the traffic controller.

In various embodiments of the invention, the vehicle 6 may include at least one of a bicycle, an automobile, a truck, a tractor, a trailer, and/or an airplane. Traffic reports may be provided for bicycles separate from automobiles, etc. traveling through intersections such as the MIMO node 7.

The wireless communications 26 will be discussed in greater detail later. The traffic controller 32 may communicate 38 with the traffic management system 38 to deliver the first vehicle detection 300-1 based upon the response of the third sensor node 20-3 and/or the sensor cluster 22, as well as the second vehicle detection 300-2 resulting from 31 the first inductive loop 30-1 responding to the vehicle 6 passing near 4 the first inductive loop.

By way of example, three sensor nodes 20-1, 20-2 and 20-3 may be positioned in pavement in the first in Lane 8 and the first out lane 8 the roadway 9. These two lanes feed the left side of the MIMO node 7.

A sensor cluster 22 may include a first sensor node 20-1 and a second sensor node 20-2 that may contribute their responses to the vehicle 6 passing near 4 them to generate the first vehicle detection 300-1 by the processor 200. The sensor cluster 22 may be configured to act like an inductive loop 30 in response to the vehicle 6 passing near 4 to the sensor nodes. Both sensor nodes may be installed so that the vehicle 6 approaches the first sensor node 20-1 before traveling away from the second sensor node 20-2. The first sensor node 20-1 may contribute to indicating the start 302 of the first vehicle detection. The second sensor node 20-2 may contribute to indicating the end 304 of the first vehicle detection.

The traffic management system 50 may preferably find the response of the sensor cluster 22 and/or the third sensor node 20-3 to be statistically compatible with the second vehicle detection 300-2 generated based upon the response of the first inductive loop 30-1 to a vehicle 6 passing near 4 the first inductive loop. The traffic management system may use these two vehicle detections 300-1 and 300-2 in a compatible fashion to generate a traffic flow estimate 308 of the various lanes 8 in the roadway 9.

Because of the compatibility of the first vehicle detections 300-1 from the sensor nodes 20-3 and/or the sensor cluster 22 with the second vehicle detections 300-2 from the inductive loop, the traffic management system can generate the traffic flow estimate 308 from any combination of inductive loops 30-1 and/or 30-2, the third sensor nodes 20-3 and/or the sensor cluster 22.

Further, these traffic flow estimates 310 may be used by an adaptive control system 52 to control the traffic on the roadway 9 and/or at the MIMO node 7 through the generation of a signal plan update 320 that may be sent via 38 to the traffic controller 32 to potentially alter and/or generate the traffic signal plan 36. The traffic controller may direct the traffic signals 33 based upon the traffic signal plan to implement the traffic management system's control the traffic flow.

The processor 200 may generate the first vehicle detection 300-1 in response to the sensor nodes 20 positioned in the roadway 9, more specifically in a lane 8 to detect a vehicle 6 passing near 4 one or more of the sensor nodes 20-1, 20-2 and/or 20-3.

FIG. 1 also shows a third sensor node 20-3 configured to wirelessly communicate 26 with a repeater 110 that further communicates 112 with the access point 100. Repeater communications 112 may include wireless communications and/or wireline communication, which will be discussed in greater detail later.

The traffic controller 32 may, for example, include of a Model 170, and/or a Model 2070, and/or a NEMA TS1 detector rack, and/or a NEMA TS2 detector rack. The following are considered fairly standard terms for traffic controllers, either as the result of a standardization group and/or through common use: NEMA, 170, 2070, and ATC. As of the time of filing this patent application, the following companies were considered to manufacture implementations of the traffic controller 32: Scae, Peek, Siemens, Econolite, and Naztec. Note that this list is not meant to be exhaustive, but rather to provide examples of the start of the art at the time of the filing of this application.

As another set of examples, the traffic management system 50 may include at least one of the following:

Concert is a Siemens Company Trade name,

ACTRA is a Siemens Company Trade name,

TACTICS is a Siemens Company Trade name,
Icons is a Siemens Company Trade name,
I2 is a Siemens Company Trade name,
KITS stands for Kimley-Horn Integrated Transportation System,
TransSuite is a Transcore trade name,
Surveillance 360 is an ICX Trade name,
Delcan is a Company name, and/or
Quicknet is a Company trade name.

The traffic management system 50 may adaptively direct via communication 38 the traffic controller 302 in response to the traffic flow estimate 308. The traffic management system may further adaptively direct based upon an adaptive control system 52, for example, as at least one of the following:

SCOOT stands for Split Cycle Offset Optimization Technique,
SCATS stands for Sydney Coordinated Adaptive Traffic System,
ACS-Lite is a FHWA Issued name,
LA DOT,
ATSAC stands for Automated Traffic Surveillance and Control,
Midas stands for Motorway Incident Detection and Automatic Signaling,
Mova stands for Microprocessor Optimized Vehicle Actuation,
Rhodes stands for Real Time Hierarchical Optimized Distributed Effective System,
OPAC stands for Optimized Policies for Adaptive Control,
In-Sync, a company trade name,
Utopia stands for Urban Traffic Optimization by Integrated Automation, and
Quick Track is a McCain Company Trade name.

The adaptive control system 52 may be implemented as a processor, like the processor 200, or as the processor 200. Alternatively, the adaptive control system 52 may be implemented as a program system, which will be described in greater detail starting with FIG. 9.

Figure 2:
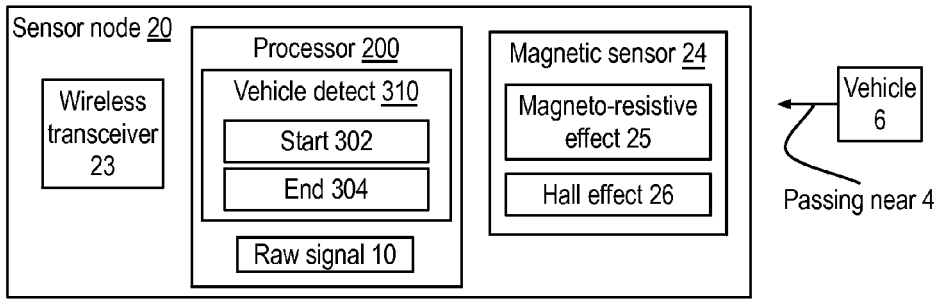
FIG. 2 shows an example of one of the sensor nodes of FIG. 1 including a wireless transceiver and a magnetic sensor employing a magneto-resistive effect and/or a Hall effect.

At least one of the sensor nodes 20, such as 20-1, 20-2 and/or 20-3, may include a wireless transceiver 23 to at least partly deliver the vehicle detection 300 and/or the sensor node may include a magnetic sensor 24 configured to respond to the presence of the vehicle 6 to at least partly generate the vehicle detection 300, as further shown in FIG. 2.

Sending the vehicle detection 300 may also vary between different implementations. In some embodiments, the sending may support triggering a switch or relay to ground to assert vehicle 6 presence and may trigger to a voltage, say 12, 24 and/or 48 volts to unassert the vehicle presence. In other embodiments assertion and its logical complement, unassertion may be reversed. In yet other embodiments, sending the vehicle detection may involve packets and/or messages sent compliant with a wireline and/or wireless communication protocol.

FIG. 2 shows an example of one of the sensor nodes 20 of FIG. 1 including a wireless transceiver 23 and a magnetic sensor 24 employing a magneto-resistive effect 25 and/or a Hall effect 26 to generate a raw signal 10 that is used to generate a vehicle detection 300 in response to the vehicle 6 passing near 4 the magnetic sensor 24. The vehicle detection 300 may be at least partly generated as a vehicle detect 310 that may include a start time 302 and/or an ending time 304. Note that the sensor node 20 may include the processor used to generate part or all of the vehicle detection 300, for instance the start 302 and/or the end 304.

The wireless transceiver 23 may employ at least one wireless communications protocol that may employ at least one of the following: a time division multiple access protocol, a frequency division multiple access protocol, a code division multiple access protocol, a frequency hopping multiple access protocol, a time hopping multiple access protocol, a near-field wireless connection and/or a wavelet division multiple access protocol.

The magnetic sensor 24 may employ the Hall effect 25 and/or a magneto-resistive effect 26, to respond to the presence of the vehicle 6 passing near 4 the magnetic sensor 24 to at least partly generate the vehicle detection 310.

FIGS. 3A to 3D show some details of various examples of the sensor cluster 22 and its relationship to an inductive loop 30.

Figure 3A:
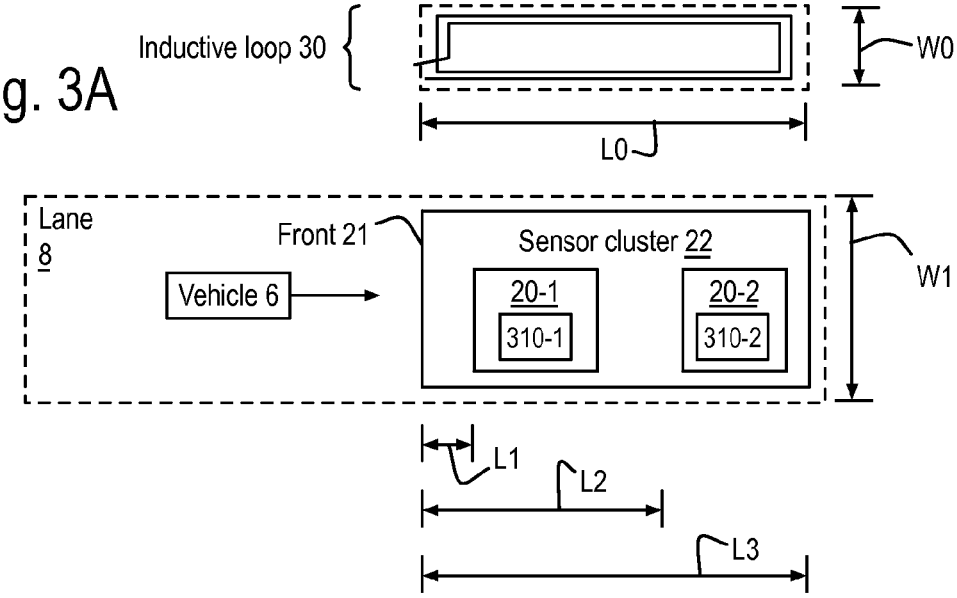
FIGS. 3A to 3D show some details of various examples of the sensor cluster and its relationship to an inductive loop.

FIG. 3A show some details of various embodiments of the sensor cluster 22 and its relationship to an inductive loop 30, for instance, the first inductive loop 30-1 or the second inductive loop 30-2 of FIG. 1. The inductive loop 30 may have an effective width, referred to herein as the inductive loop width W0, which may be at least three feet for pedestrian paths and/or bicycle paths, and may be at least six feet and/or 2 meters for some lanes 8.

The sensor cluster 22 may have its effective width, referred to herein as the sensor cluster width W1 that may approximate the inductive loop width within a range of no more than 20 percent, in other words, from 80% of the W0 to 120% of the W0. In other situations, W1 may approximate W0 to within 10% and in certain situations, to within 5%.

The inductive loop 3 have an effective length of L0, which may be greater than three meters and may further be less than six meters. The effective length L0 may further be greater than three and a half meters and less than five meters. In some situations, the effective length L0 may be specified as four and a half meters to within a range of ten percent or less.

The sensor cluster 22 may have two or more length parameters associated with it. Some of these parameters (L1 and L2) may be associated with a front 21 of the sensor cluster where a vehicle 6 most probably enters the sensor cluster's ability to sense its presence, whereas other parameters such as L3 may not need to be directly associated with the front.

The first length parameter L1 may represent the offset from the front 21 of the sensor cluster 22 to the first sensor node 20-1, which may be at least one foot and may further be at least 18 inches and may further be at least two feet, or 60 centimeters (cm).

The second length parameter L2 may represent the offset from the front 21 of the sensor cluster 22 to the second sensor node 20-2, which may be at least two meters, and may further be at least two and a half meters.

The third length parameter L3 may be the effective length of the sensor cluster 22, which may approximate the effective length L0 of the inductive loop 30 to within a range of twenty percent, or ten percent, or five percent, or less.

Note the following example: Suppose the inductive loop effective length L0 may be specified to be four and a half meters to within a range of ten percent. The third length parameter L3 may be four and a half meters also within a range of ten percent.

The magnetic sensor 24 may further generate a sensor reading, which will be referred to as the raw signal 10, in response to the presence of the vehicle 6 in at least two and possibly three dimensions, with the sensor reading being used to at least partly generate the vehicle detection 300.

While FIG. 3A shows the sensor nodes 30-1 and 30-2 positioned asymmetrically with respect to the geometric center of the lane 8, this is not intended to limit the scope of the claims. It may be preferred to position the sensor nodes 20-1 and/or 20-2 near the center of the lane in some situations as shown in FIG. 1. In other situations, the sensor nodes may be positioned to most effectively respond to the turning of the vehicle 6.

Figure 3B:
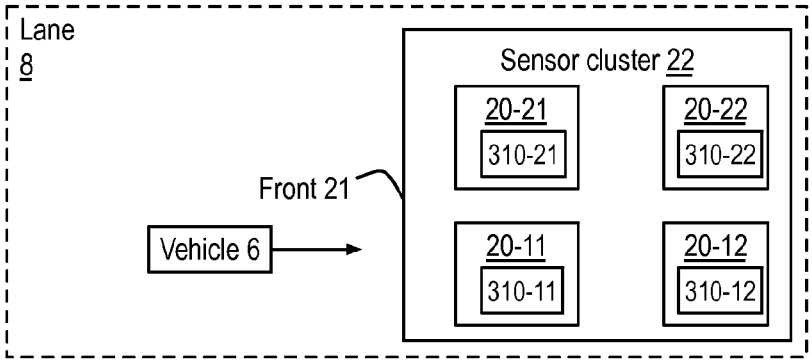
Figure 3C:
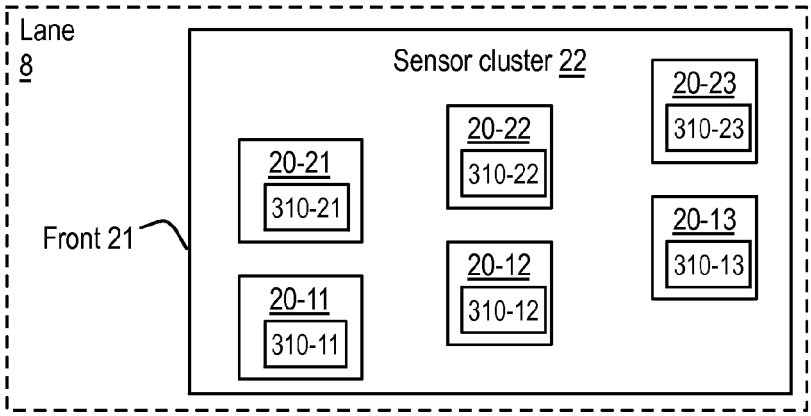
Figure 3D:
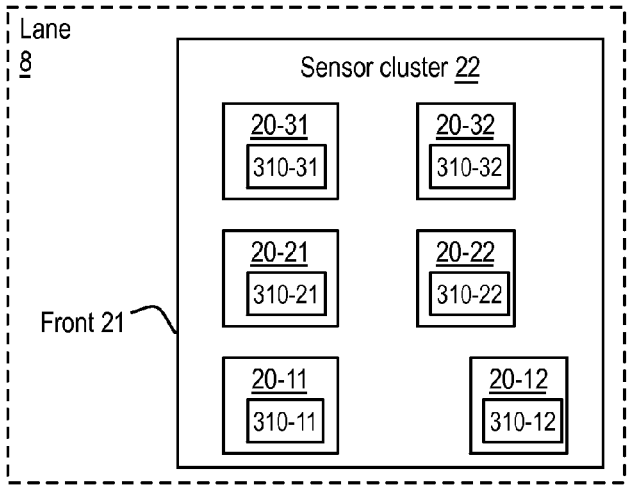

FIGS. 3B to 3D show some examples of other embodiments of the sensor cluster 22 involving differing numbers and arrangements of the sensor nodes 20.

FIG. 3B shows an example of the sensor cluster 22 including four instances of the sensor nodes 20 arranged as two columns. The first column includes the sensor node 20-21 and the sensor node 20-11. The second column includes the sensor node 20-22 and the sensor node 20-12. The configuration of the sensor cluster 22 may support the vehicle 6 moving over and/or near the sensor nodes 20-21 and/or 20-11 of the first column before passing the second column sensor nodes 20-22 and/or 20-12.

FIG. 3C shows an example of the sensor cluster 20 with three columns that may be arranged on a slant. The first column includes the sensor node 20-21 and the sensor node 20-11. The second column includes the sensor node 20-22 and the sensor node 20-12. The third column includes the sensor node 20-23 and the sensor node 20-13.

FIG. 3D shows an example of the sensor cluster 22 including six instances of the sensor nodes 20 arranged as two columns. The first column includes the sensor node 20-31, the sensor node 20-21 and the sensor node 20-11. The second column includes the sensor node 20-32, the sensor node 20-22 and the sensor node 20-12. The configuration of the sensor cluster 22 may support the vehicle 6 moving over and/or near the sensor nodes of the first column before passing the second column sensor nodes.

Figure 4:
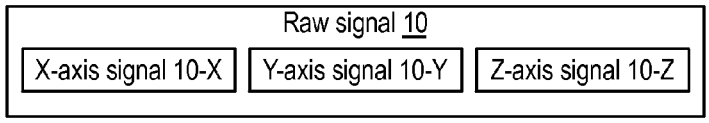
FIG. 4 shows some details of the raw signal of FIG. 2 received from the magnetic sensor.

FIG. 4 shows some details of the raw signal 10 of FIG. 2 of the processor 200 generated in response to the vehicle 6 passing near 4 from the magnetic sensor 24. The raw signal 10 may include a one-dimensional, two-dimensional and/or a three dimensional reading, shown here though the example of the three Cartesian coordinates, the X-axis signal 10-X, the Y-axis signal 10-Y and the Z-axis signal 10-Z. Note that other examples of the raw signal 10 may be implemented using polar and/or cylindrical coordinate systems.

Figure 5A:
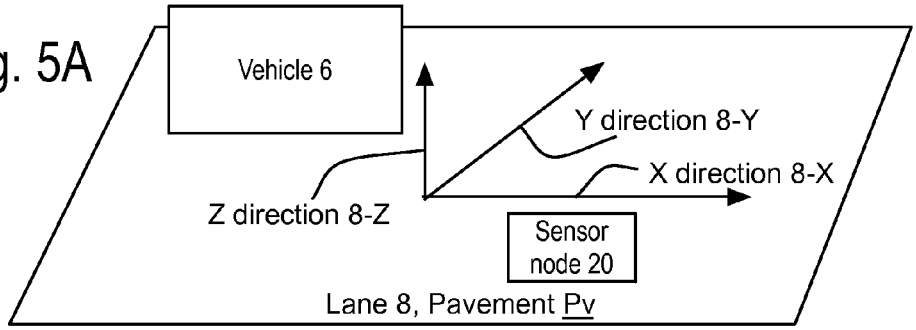
FIGS. 5A and 5B show some details of how the components of the raw signal are related to the pavement of the lane in which the sensor node is installed.
Figure 5B:
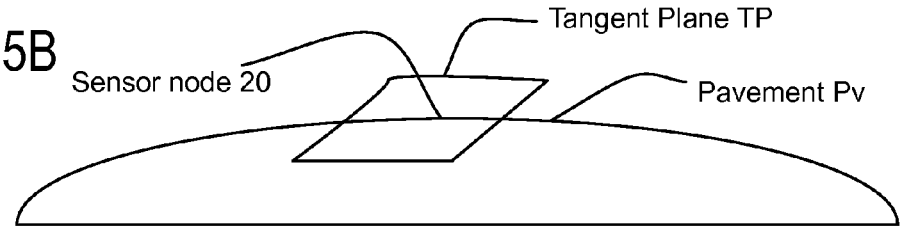

FIGS. 5A and 5B show some details of how the components of the raw signal 10 may be related to the pavement Pv of the lane 8 in which one of the sensor nodes 20 is installed. By way of example, the Z-direction 8-Z may be perpendicular to the pavement, whereas the X direction 8-X and the Y direction 8-Y may be in the local tangent plane Tp of the pavement Pv. As shown in FIG. 5A, when the pavement is locally flat, this may form as shown, a right handed coordinate system. Alternatively, the coordinate system may be a left handed coordinate system. While these Figures show examples of flat and convex pavement, the pavement may also be concave.

Various embodiments may be implemented differently, the sensor node 20 response to the vehicle 6 may include extending the vehicle detection 300 to be compatible with the inductive loop 30 for a specific adaptive control system 52. By way of example, if the adaptive control system 52 employs SCATS, the extension may vary based upon the estimate speed of the vehicle. Another example, if the adaptive control system employs SCOOT, the extension may be a fixed amount, say about 200 milliseconds.

Figure 6:
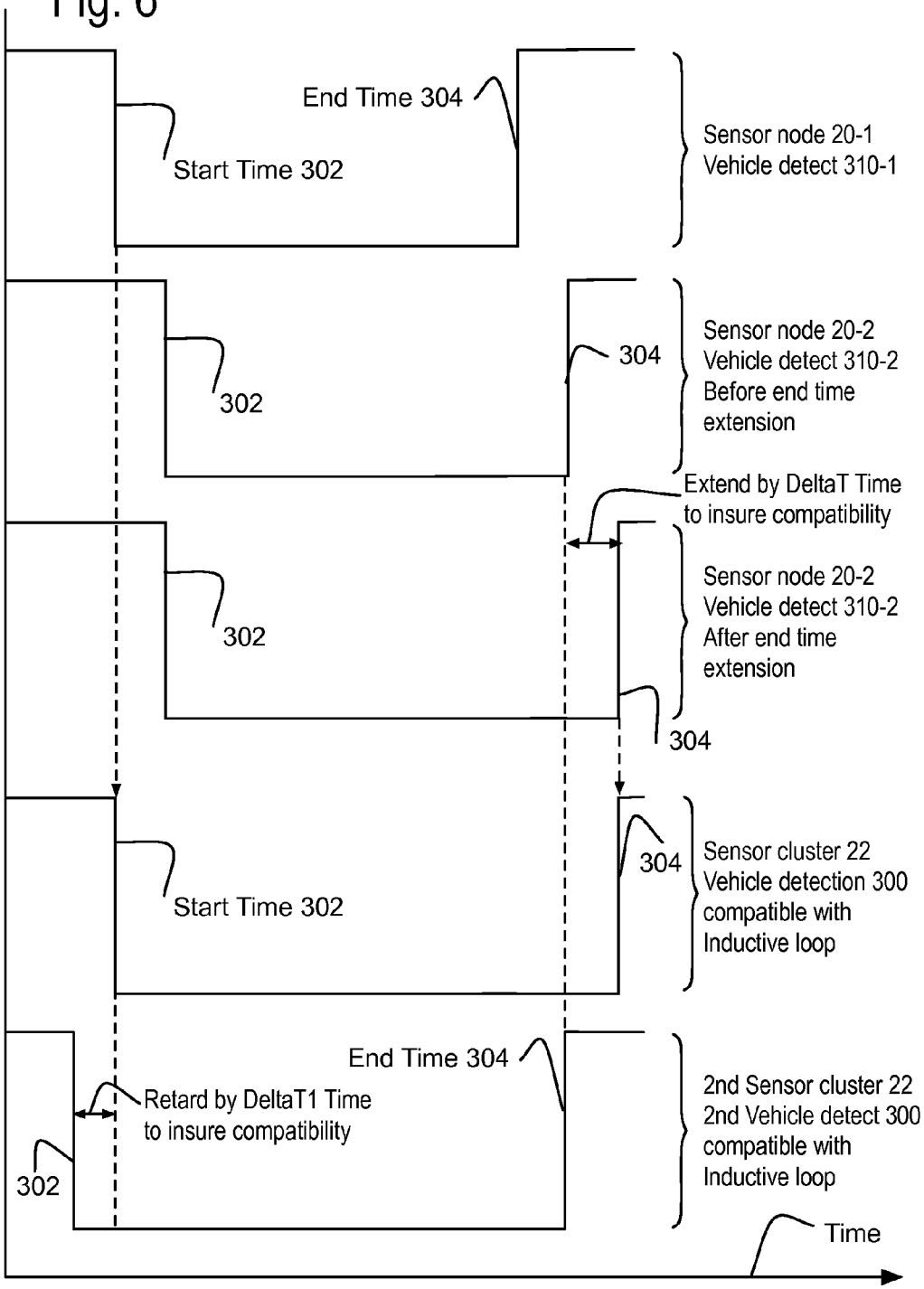
FIG. 6 shows an example of how the sensor node may generate its detection of the presence of the vehicle passing near the magnetic sensor, which may or may not include altering the start time and/or the end time.

FIG. 6 shows how the first vehicle detects of the first and second sensor nodes in the sensor cluster 22 may be used to generate a vehicle detection 300 that is statistically compatible with an inductive loop such as the inductive loop 30-1. The first vehicle detect 310-1 of the first sensor node 20-1 and the second vehicle detect 310-2 of the second sensor node 20-2 may be used to generate the vehicle detection 300 of the vehicle 6 passing near these sensor nodes.

The vertical axis represents a Boolean value, which is asserted in the low state and unasserted in the high state. The horizontal axis represents time, which may be measured in time increments, such as seconds or fractions of seconds.

Generating the vehicle detection 300 may include altering the vehicle detection to be compatible with the inductive loop 30 for a specific traffic management system 50 and/or the adaptive control system 52. The alteration may alter the ending time 304 and/or the start time 302 of the vehicle detection 300. The alteration may retard or extend one or both of these times. As used herein, retarding a time moves it earlier and extending a time moves it later.

FIG. 6 shows five traces, representing the following from the top to the bottom:

- The first trace shows the first vehicle detect 310-1 generated in response to the vehicle 6 passing near 4 the first sensor node 20-1.
- The second trace shows the second vehicle detect 310-2 generated in response to the vehicle 6 passing near 4 the second sensor node 20-2.
- The third trace shows second vehicle detect 310-2 with its end time 304 extended by a DeltaT.
- The fourth trace shows the vehicle detection 300 for the sensor cluster 22 that may be compatible with the inductive loops such as the inductive loop 30-1.
- And the fifth trace shows a second vehicle detection 300 with its start time 302 retarded by DeltaT1 from the start time 302 of the first vehicle detect 310-1 generated by the first sensor node 20-1. Note that DeltaT may or may not have the same value as DeltaT1.

The start time 302 of the first vehicle detect 310-1 may be merged with the end time 304 of the second vehicle detect 310-2 to generate the vehicle detection 300, both of which may not be extended in some embodiments.

To summarize the examples of altering the start times 302 and the end times 304 in certain embodiments of the vehicle detection 300 supporting inductive loop 30 compatibility: The end time 304 may be extended by a DeltaT to insure the compatibility, which is seen in the third trace. The start time 302 may be retarded by DeltaT1, which is seen in the fifth trace.

Figure 7:
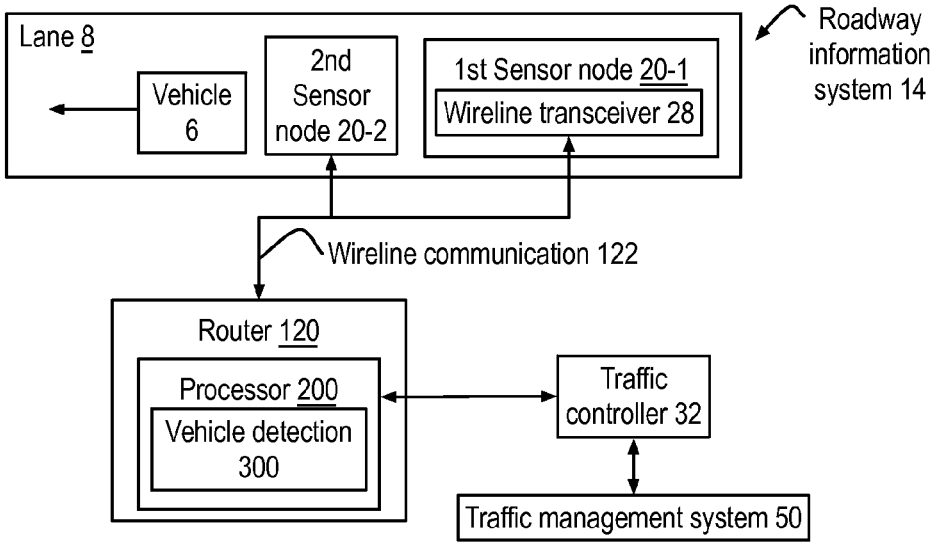
FIG. 7 shows how the first and second sensor node vehicle detections may be used to generate a vehicle detection of the vehicle passing near the sensor nodes that is statistically compatible with the inductive loop.

FIG. 7 shows an example of the roadway information system 14 operating and using the sensor nodes 20-1 and 20-2 to wireline communicate 122 with a router 120 including an implementation of the processor 200 of FIG. 1.

The sensor node 20 may also include a wireline transceiver 28 possibly compliant with a wireline communications protocol. The wireline communications protocol may be Ethernet, possibly Power Over Ethernet, and/or RS-485. The wireline communication 122 may be arranged in a fault tolerant network that can lose a percentage of its wire lines and still function.

FIGS. 8A to 8F show examples of the variations in implementation using the sensor networks of FIG. 1 and/or FIG. 7 in various roadway information system 14 configurations.

Figure 8A:
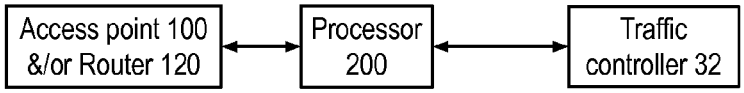
FIGS. 8A to 8F show examples of the variations in implementation using the sensor networks of FIG. 1 and/or FIG. 7.
Figure 8B:
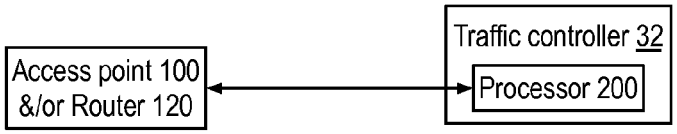
Figure 8C:
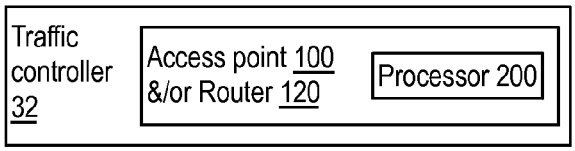

- FIG. 8A shows a variation with the processor 200 not included in the access point 100 or the router 120 or the traffic controller 32.
- FIG. 8B shows a second variation with the processor 200 included in the traffic controller 32 but not in the access point 100 or the router 120.
- FIG. 8C shows a third variation with the traffic controller 32 including the access point 100 and/or the router 120, which further includes the processor 200.

Figure 8D:
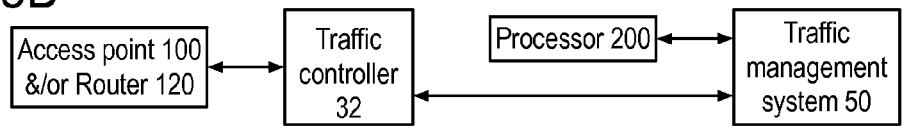

FIG. 8D shows a fourth variation with the processor 200 separate from the access point 100, the router 120 and the traffic controller 32, with the processor 200 communicating directly with the traffic management system.

Figure 8E:
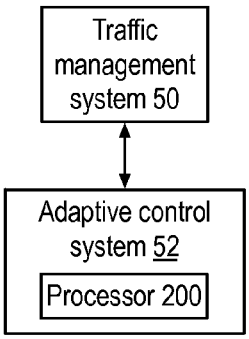

FIG. 8E shows a fifth variation with the processor 200 included in the adaptive control system 52.

Figure 8F:
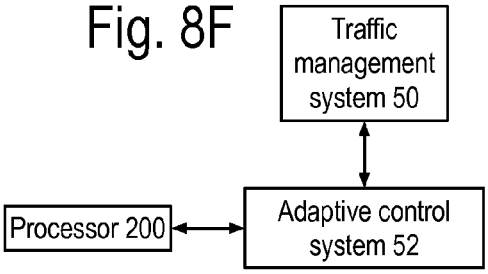

FIG. 8F shows a sixth variation with the processor 200 communicating with the adaptive control system 52.

These FIGS. 8A to 8F show some examples of the use of the processor 200 in various implementations of roadway information systems 14, but are not meant to limit the scope of the Claims.

Figure 9:
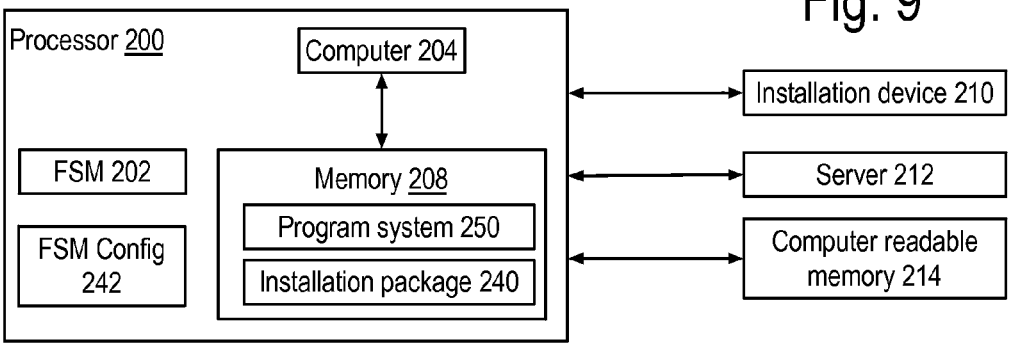
FIG. 9 shows examples of the apparatus that may include the processor of previous Figures, finite state machines, computers, memories, program systems, installation packages, installation devices and/or servers.

FIG. 9 shows an example of the processor that may include at least one instance of a Finite State Machine (FSM) 202 and/or an instance of a computer 204 and/or an instance of a memory 208 that may include a program system 250 configured to instruct the computer to at least partly implement the operations of the invention's methods.

The memory 208 may include an installation package 240 that may be configured to instruct the computer to install the program system 250 to instruct the computer and/or to configure the FSM 202. In some embodiments, the processor may include more than one instance of the FSM 202 and/or more than one instance of the computer 204, and the installation package 250 may be used to install the program system 250 into some and/or all the instances.

FIG. 9 also shows the apparatus disclosed and claimed to include an installation device 210 and/or a server 212 and/or a computer readable memory 214, any or all of which may be configured to deliver to the processor 200, the computer 204 and/or the memory 208 at least part of the program system 250 and/or the installation package 240.

As used herein, a FSM 202 may be configured to receive at least one input, maintain at least one state and generate at least one output in response to a value of at least one of the inputs and/or in response to the value of at least one of the states. The FSM configuration 242 may be used to configure the FSM 202 implemented by a programmable logic device, such as a Field Programmable Gate Array (FPGA) to at least partly implement the processor 200.

As used herein, the computer 204 may include at least one instruction processor and at least one data processor with at least one of the instruction processor instructed by at least one of the instruction processors in response to the program system 250, possibly through accesses of the memory 208 by the computer.

As used herein, the installation package 240 may be configured to instruct the computer 204 to install the program system 250 and/or may be configured to instruct the computer and/or the FSM 202 to install the FSM configuration 242. In some embodiments the installation package may include files or folders that may be nested one or more layers deep, which may or may not be compressed. The files may include text that may be compiled, or translated, or linked, or loaded by the computer to at least partly generate and/or install the program system and/or the FSM configuration.

As used herein, the memory 208 and/or the computer readable memory 214 may include at least one instance of a volatile and/or a non-volatile memory component. A volatile memory component tends to lose its memory contents without a regular supply of power, whereas a non-volatile memory component tends to retain its memory contents without needing such a regular supply of power.

The memory 208 and/or the computer readable memory 214 and/or the server 212 and/or the installation device 210 may include various communications interfaces to deliver the program system 250, the installation package and/or the FSM configuration 242:

- a USB interface,
- a disk drive interface such as the ATA or Serial ATA interface
- a Firewire interface,
- a Bluetooth interface,
- a Local Area Network (LAN) interface, and/or
- a Wireless LAN (WLAN) interface,
- and/or some combination of these and possibly other interfaces.

Figure 10A:
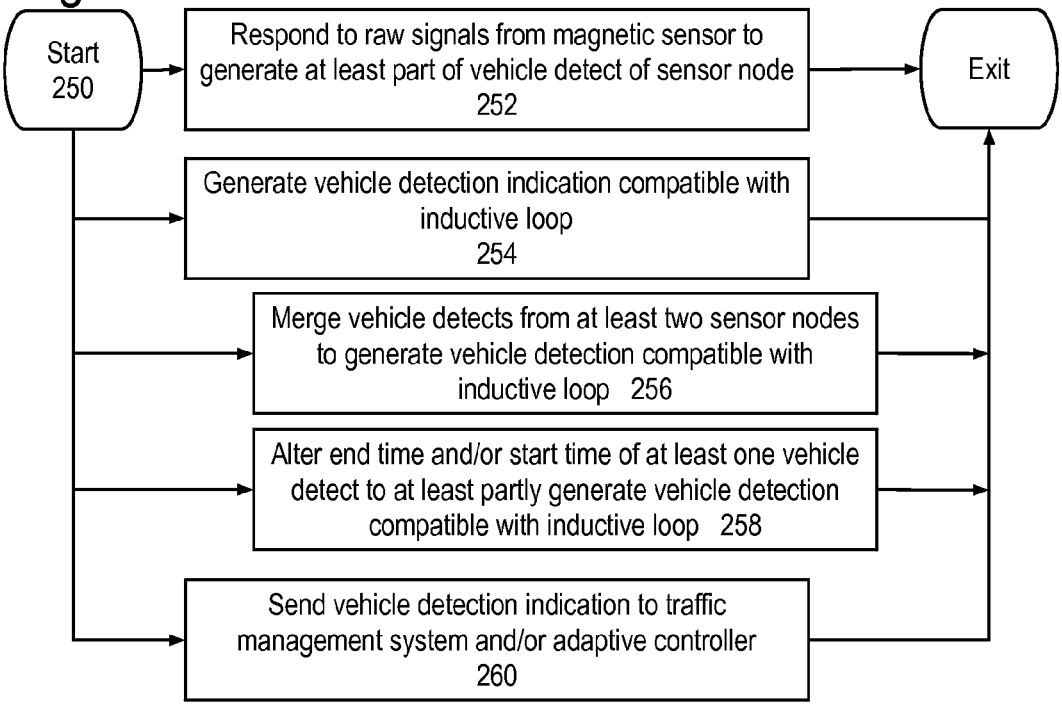
FIGS. 10A and 10B show some details of various embodiments of the program system disclosing some details of the method of operating the various examples of the apparatus of the previous Figures.
Figure 10B:
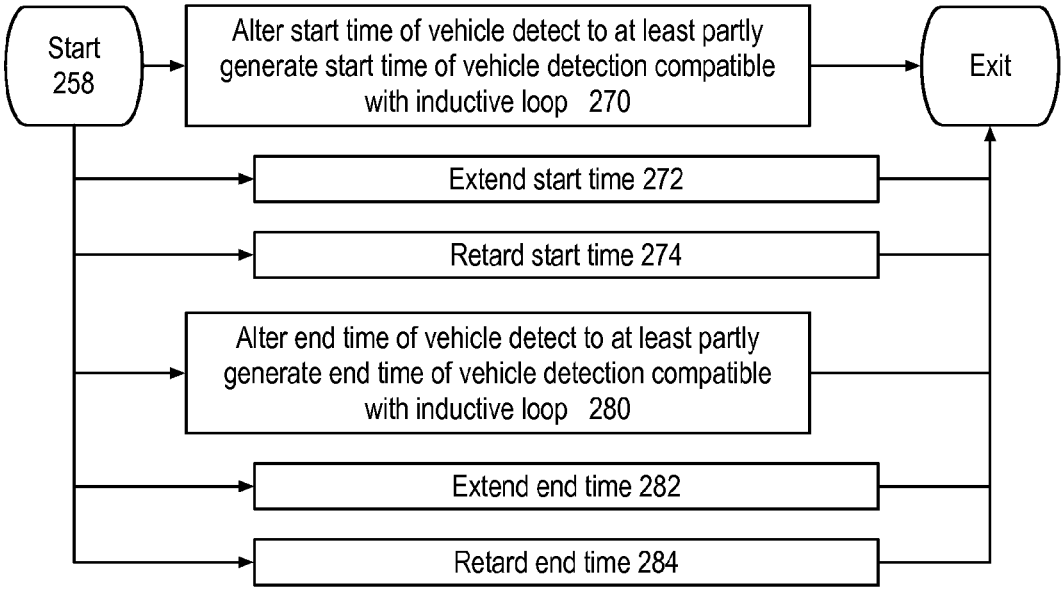

FIGS. 10A and 10B show some details of various embodiments of the program system 250 disclosing some details of the method of operating the various examples of the apparatus that may include the processor 200 of the previous Figures.

FIG. 10A shows some details of various embodiments of the program system 250 that may include at least one of the following program steps:

Program step 252 supports responding to the raw signals 10 from the magnetic sensor 24 to generate at least part of the vehicle detect 310 of the sensor node 20. This program step may be implemented by the sensor node and/or by the processor 200 and/or by the router 120. An example of these operations will be presented in FIG. 11 which follows.

In certain implementations, such as when the processor and router are in wireline communication 122 with the sensor nodes 20-1 and 20-2 of FIG. 7, the raw signals may be communicated to the processor and/or the router.

In certain other implementations, when the sensor nodes wirelessly communicate 28 with the access point 100, these operations may be performed at the sensor node, which may further employ further operations to estimate the raw samples at a higher frequency than they are actually sampled, for instance, effectively doubling the sampling frequency, while actually adding only a small fraction to the energy dissipation sampling period.

Program step 254 supports generating the vehicle detection 300 by using the sensor node 20 response to the presence of the vehicle 6, which may be represented as the vehicle detect 310. This operation and its implementation as the program step 254 may further include the program step 256 and/or the program step 258, which will now be discussed:

Program step 256 supports merging the vehicle detects 310 from at least two sensor nodes 20 to generate at least one of the vehicle detections 300 statistically compatible with the inductive loop 30.

By way of example, as shown in the discussion of FIG. 6, the vehicle detects 310-1 from sensor node 20-1 and the vehicle detect 310-2 from sensor node 20-2 may be merged to generate the vehicle detection 300. The start time 302 may be used from the first vehicle detect 310-1 and the ending time 304 may be used from the second vehicle detect 310-2 to generate the vehicle detection 300.

Program step 258 supports altering the starting time 302 and/or the ending time 304 of one of the vehicle detects 310 to generate the vehicle detection 300 that is statistically compatible with the inductive loop 30. This program step will be discussed in further detail in FIG. 10B, which follows.

Program step 260 sending the vehicle detection 300 to the traffic management system 50 and/or the adaptive control system 52.

FIG. 10B shows some details of various implementations of program step 258 of FIG. 10A, that support altering the start time 302 and/or the end time 304 of the vehicle detect 310 to at least partly generate the vehicle detection 300 to insure statistical compatibility with the vehicle detection 300 of the inductive loop 30. The program step 258 may include the program step 270 and/or the program step 280.

Program step 270 supports altering the start time 302 of the vehicle detect 310, for example the first vehicle detect 310-1 of FIG. 6, to at least partly generate the vehicle detection 300.

Program step 280 supports altering the end time 304 of the vehicle detect 310, for example the second vehicle detect 310-2 of FIG. 6, to at least partly generate the vehicle detection 300.

These two program steps 270 and 280 may have different implementations in order to insure statistical compatibility with inductive loops 30 for differing embodiments of the traffic management system 50, the adaptive control system 52, the MIMO node 7 and/or the roadway 9.

Program step 270 may alter the start time 302 of the vehicle detect 310, by including one of the following:

Program step 272 extends the start time 302.

Program step 274 retards the start time 302 as shown in the fifth trace of FIG. 6.

Program step 280 may alter the end time 304 of the vehicle detect 310, by including one of the following:

Program step 282 extends the end time 304 as shown by the third trace.

Program step 284 retards the end time 304.

Figure 11:
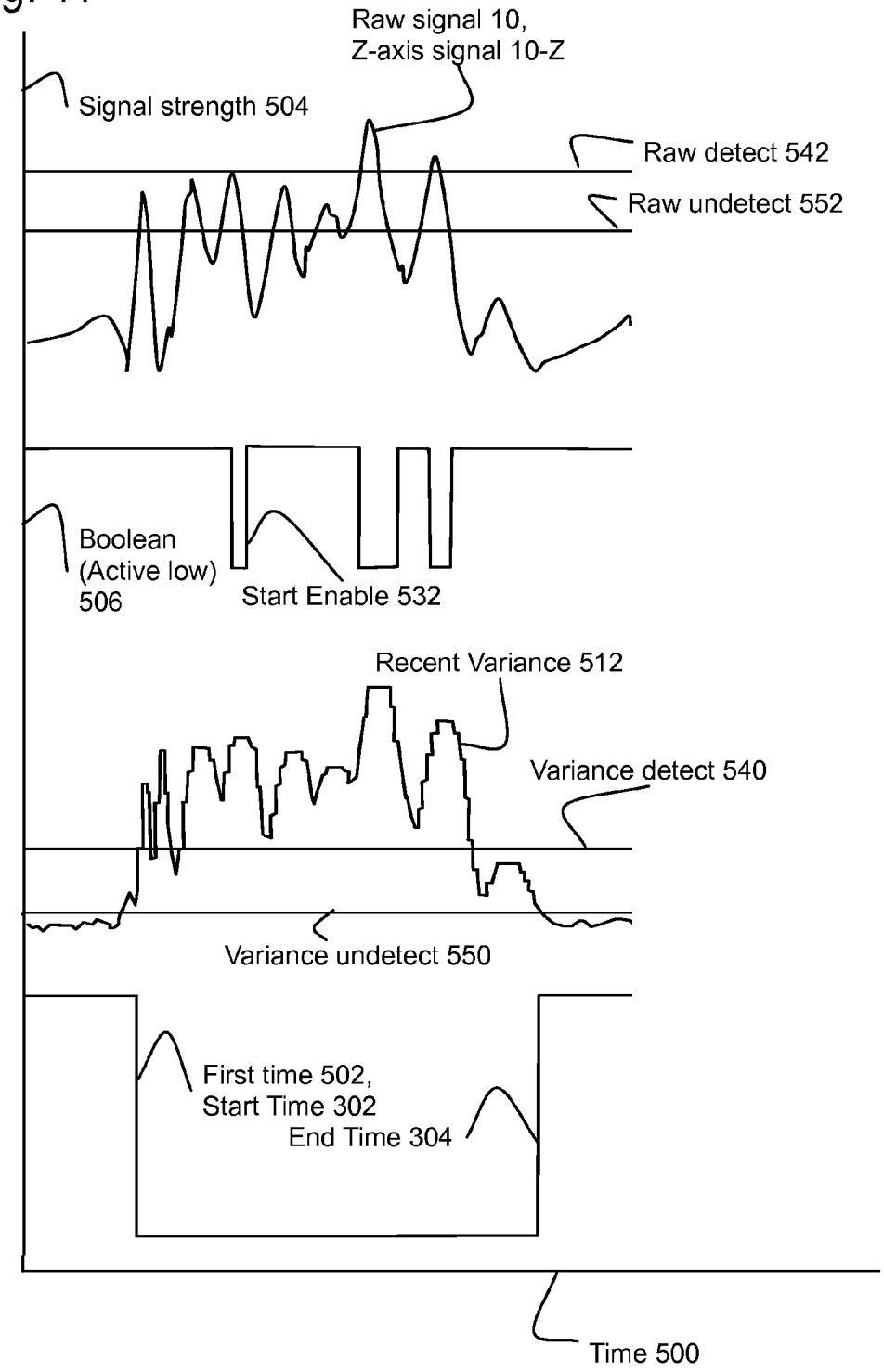
FIG. 11 shows some details of responding to the raw signals from a magnetic sensor to generate at least part of a vehicle detect of one of the sensor nodes.

FIG. 11 shows some details of responding to the raw signals 10 from a magnetic sensor 24 to generate at least part of a vehicle detect 310 of one of the sensor nodes 20. This Figures shows four traces superimposed on a graph, with the top trace representing the raw signal 10, in particular, the Z-axis signal 10-Z, the second trace being the start enable 532, which will be discussed shortly, the third trace being the recent variance 12, and the fourth, bottom, trace representing the vehicle detect 310 and possibly the vehicle detection 300.

The vertical axis representing signal strength 504 is used with the raw signal 10, in particular the Z-axis signal 10-Z, and with the recent variance 512.

The vertical axis is also used to represent a Boolean active low condition, where a low value is true and a high value is not true, or false. The second trace of the start enable 532 and the vehicle detect 310 use the Boolean active low interpretation.

The horizontal axis represents time 500 for all four traces.

A sensor node 20 and/or the processor 200 may respond to the passage 4 of a vehicle 6 near the sensor node, for instance, the first sensor node 20-1 and/or the second sensor node 20-2 by using a raw signal received as a magnetic sensor signal from the magnetic sensor to generate a start time and an ending time for the vehicle passing near the magnetic sensor, by performing the following steps:

A first time 502 may be captured from the current time 500 when the recent variance 512 of the raw signal 10 goes above a variance detect 540.

The start enable 532 may be asserted when the raw signal 10 goes above a raw detect 542 and the recent variance 512 of the raw threshold is above the variance detect 540.

The start time 302 is second captured from the first time 502 when the assertion of the start enable begins 532.

The ending time 304 is third captured from the current time 500 when both a first condition and a second condition become true, where the first condition is that the recent variance 512 of the raw signal 10 is below a variance undetect 550 and the second condition is that the raw signal 10 is below a raw undetect 552.

The variance detect 540 may be above the variance undetect 550, and the raw detect 542 may be above the raw undetect 552.

Note that in various embodiments, the quantities and/or the Boolean values shown in FIG. 11 may be stored in locations in the memory 208 and/or in registers of the finite state machine 202 and/or the computer 204. The quantities may be formatted and/or handled as fixed point or as floating point numbers. The Boolean values may be stored as bits or collections of bits.

The preceding discussion serves to provide examples of the embodiments and is not meant to constrain the scope of the following claims.

The invention claimed is:

1. An apparatus comprising a processor configured to use at least one response of at least one sensor node positioned and using a magnetic sensor to detect the presence of a vehicle in a roadway to generate a vehicle detection to which said sensor node operates a wireless transceiver to deliver said response to said detect of said vehicle to at least partly generate said vehicle detection for use by a traffic management system to provide a traffic flow estimate of said roadway to direct at least one traffic controller, wherein said vehicle detection is statistically compatible with a vehicle detection of said vehicle by an inductive loop positioned near said sensor node.

2. The apparatus of claim 1, further comprising at least one of said traffic management system configured to direct said at least one traffic controller in response to said traffic flow estimate; and said sensor node configured to use at least one of said wireless transceiver and said magnetic sensor, wherein said wireless transceiver configured to at least partly deliver said response of said detect of said vehicle to at least partly generate said vehicle detection, and wherein said magnetic sensor configured to generate said response to said presence of said vehicle.

3. The apparatus of claim 2, wherein said wireless transceiver is compatible with a version of at least one wireless communications protocol; and wherein said magnetic sensor employs at least one of a Hall effect and a magneto-resistive effect, to generate said response to said presence of said vehicle.

4. The apparatus of claim 1, wherein said processor includes at least one instance of at least one of a finite state machine, a computer, and a memory configured to be accessed by said computer, with said memory containing at least one of a program system and an installation package configured to instruct said computer to install said program system in at least one of said finite state machine and said computer.

5. At least one of a server, an installation device, and a computer readable memory, each configured to deliver at least one said program system and said installation package of claim 4 to said processor.

6. The apparatus of claim 4, wherein said program system comprises at least one of the program steps of:

using said response to said presence of said vehicle by said sensor node to generate said vehicle detection compatible with said vehicle detection by said inductive loop; and sending said vehicle detection to said traffic management system.

7. The apparatus of claim 1, comprising at least one of an access point configured to wirelessly communicate with said sensor node to provide said processor communication with said sensor node to at least partly generate said vehicle detection;

a router configured to wireline communicate with at least one of said sensor node and said access point to provide said processor communication with said sensor node to at least partly generate said vehicle detection;

said traffic controller configured to communicate with said traffic management system to use a traffic signal plan based upon said traffic flow estimate; and an adaptive control system configured to respond to said vehicle detection to at least partly generate at least one of said traffic flow estimate and said traffic signal plan.

8. The apparatus of claim 7, wherein said processor is included in at least one of said access point, said router, said traffic controller, said traffic management systems, said adaptive control system and at least one of said sensor nodes.

9. A sensor cluster, comprising:

said sensor cluster configured to act in a statistically compatible fashion to an inductive loop in response to a vehicle passing near said sensor cluster, comprising:

a first sensor node configured to be approached first by said vehicle to generate a start time of vehicle detection by a first installation in a pavement; and a second sensor node configured to be approached after said first sensor node to generate an end time of said vehicle detection by a second installation in said pavement, wherein said start time of said vehicle detection and said end time of said vehicle detection are statistically compatible with said response by said inductive loop of said vehicle passing close;

wherein at least one of said sensor nodes uses at least one of a wireless transceiver and/or a wireline transceiver to at least partly provide said vehicle detection, and/or a magnetic sensor to respond to said vehicle to at least partly generate said vehicle detection.

10. The sensor cluster of claim 9, wherein said second sensor node is further configured to alter at least one of said start time and said end time to insure compatibility with said response by said inductive loop.

11. The sensor cluster of claim 9, wherein at least one of said sensor nodes uses at least one of said wireless transceiver to at least partly provide said vehicle detection, said wireline transceiver to at least partly provide said vehicle detection, and said magnet sensor to respond to said vehicle to at least partly generate said vehicle detection.

12. A method, comprising the step of installing said first sensor node and said second sensor node to generate said sensor cluster of claim 9, comprising the steps:

installing said first sensor node in said pavement to generate said first installation configured to generate said start time of said vehicle detection; and installing said second sensor node in said pavement to generate said second installation configured to generate said end time to said vehicle detection; and said method further comprising altering said start time and/or said end time to improve said statistical compatibility.

13. The method of claim 12, wherein the step of installing said second sensor node further comprises altering at least one of said start time and said end time of said vehicle detection to improve statistical compatibility with said inductive loop.

14. The sensor cluster in said pavement as a product of the process of claim 12.

* * * * *